United States Patent [19]

Ghisoni

[11] Patent Number: 4,468,876

[45] Date of Patent: Sep. 4, 1984

[54] REVOLVER OF ELEVATED LOADING CAPACITY

[76] Inventor: Emilio Ghisoni, Via Villa Serafina, 4, Pavia, Italy

[21] Appl. No.: 386,590

[22] Filed: Jun. 9, 1982

[30] Foreign Application Priority Data

Jun. 10, 1981 [IT] Italy ..... 22231 A/81

[51] Int. Cl.[3] ..... F41C 1/00

[52] U.S. Cl. ..... 42/65; 42/59

[58] Field of Search ..... 42/59, 62, 65

[56] References Cited

U.S. PATENT DOCUMENTS

| | | | |
|---|---|---|---|
| 1,326,721 | 12/1919 | Glasser | 42/59 |
| 2,215,726 | 9/1940 | Masterton-Smith | 42/59 |
| 3,651,593 | 3/1972 | Clark | 42/59 |
| 3,995,390 | 12/1976 | Hupp | 42/59 |
| 4,156,981 | 6/1979 | Lusk | 42/59 |
| 4,285,152 | 8/1981 | Dean | 42/59 |

*Primary Examiner*—Charles T. Jordan

*Attorney, Agent, or Firm*—Karl F. Ross

[57] ABSTRACT

Disclosed is a revolver with a cylinder having an elevated number (e.g. 12) of cartridge chambers, this cylinder being held in a frame formed in part by a pivotable yoke on which the cylinder can be swung out laterally for reloading. The remainder of the frame is integral with a trigger guard which is located behind the cylinder and, along with other structural elements, is bracketed by a sheet-metal jacket of inverted-U shape forming the body of the firearm. A pistol grip attached to that body contains a compression spring which is coupled to the hammer of the firing mechanism and is repressible by the trigger or an independent lever to cock the hammer for double-action or single-action firing. A loader, comprising two hingedly interconnected disks juxtaposable to bracket the end flanges of a set of cartridges between them, is insertable into a clearance between the rear face of a cylinder and a stationary shield fastened to the frame.

14 Claims, 12 Drawing Figures

Fig. 2
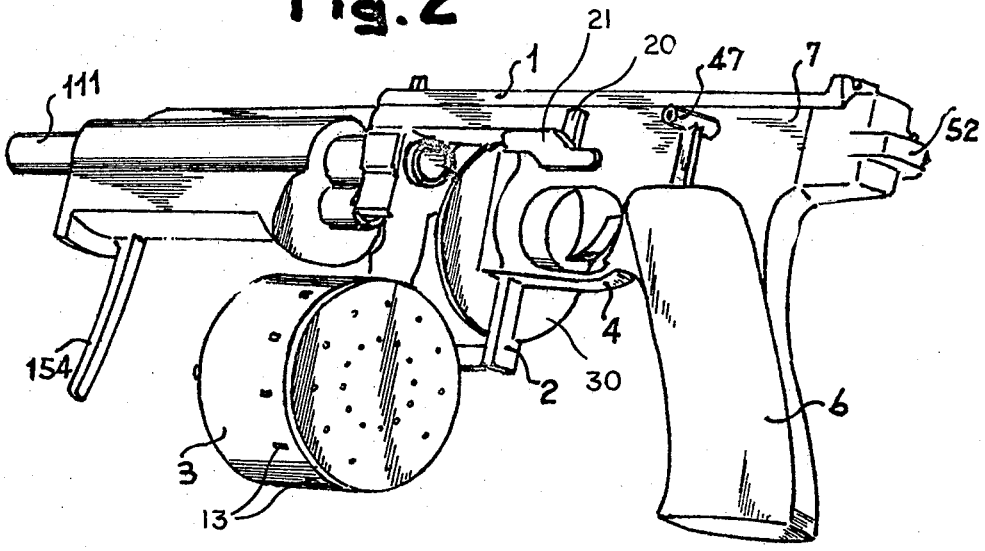
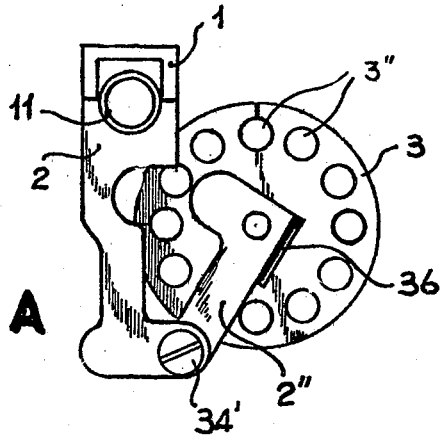
Fig. 2A

REVOLVER OF ELEVATED LOADING CAPACITY

FIELD OF THE INVENTION

My present invention relates to a revolver-type firearm or handgun loadable with an elevated number of cartridges.

BACKGROUND OF THE INVENTION

Conventional firearms of this type generally have cylinders accommodating a limited number of cartridges, usually between 5 and 8, in respective chambers. An increase in the number of chambers necessitates, of course, a corresponding enlargement of the cylinder diameter which in turn would extend the height of the firearm if, as is the case in existing models, the cylinder axis lies above the level of the trigger. Such a construction not only is clumsy but also involves a rather unbalanced distribution of masses giving rise to objectionable kicks when the gun is fired.

OBJECTS OF THE INVENTION

An important object of my present invention, therefore, is to provide a revolver which has an essentially balanced structure even if its cylinder is large enough to accommodate more than the usual number of cartridges.

Another object is to provide means in such a revolver for enabling a selected cocking of its hammer by either the trigger or an independent member for selective single-action or double-action firing.

It is also an object of my present invention to provide an improved loader adapted to be used with my novel revolver.

SUMMARY OF THE INVENTION

A revolver according to my present invention comprises a body formed by a sheet-metal jacket of inverted-U shape which is fastened at the rear to a pistol grip and from which a barrel extends forward, the walls of this jacket bracketing between them the elements of a firing mechanism as well as part of a trigger guard which is integral with a stationary section of a frame supporting an associated cartridge cylinder; this frame lies in a substantially vertical plane extending in the direction of the barrel. Another section of the frame is formed by a pivotable yoke with an upper and a lower leg paralleling the barrel, the upper leg forming an axle for the cylinder while the lower leg defines a pivotal axis about which the drum can be swung laterally outward for reloading. In its operating position, in which the cylinder shaft lies more or less directly below the barrel on the level of a trigger which is swingable about a fulcrum substantially at the barrel level, the uppermost cylinder chamber is aligned with the barrel and with a striker pin forming part of the firing mechanism. That mechanism further includes a hammer, coacting with the striker pin, and a detent coupled with the trigger for normally arresting the cylinder in a rotary position of alignment of one of its chamber with the barrel. When the trigger is pulled back, the hammer is cocked and the detent momentarily disengages the cylinder which is concurrently stepped by a pawl into a new alignment position.

Pursuant to another feature of my invention, the cocking of the hammer involves the compression of a restoring spring lodged in the pistol grip. The hammer can also be cocked by means of an actuator, independent of the trigger, in a single-action firing mode.

Still another feature of my invention resides in the provision of a loader comprising two substantially coextensive, preferably hingedly interconnected disks which are juxtaposable to bracket the end flanges of a set of cartridges between them, the juxtaposed disks constituting a pancake insertable into a clearance between the rear face of the cylinder and a stationary shield fastened to its frame.

BRIEF DESCRIPTION OF THE DRAWING

The above and other features of my invention will now be described in detail with reference to the accompanying drawing in which:

FIG. 2 is a perspective view of a modification of the revolver of FIG. 1 in a partly disassembled state;

FIG. 2A is a front-elevational view of the revolver with its cylinder swung out into a reloading position;

SPECIFIC DESCRIPTION

Figure 7:
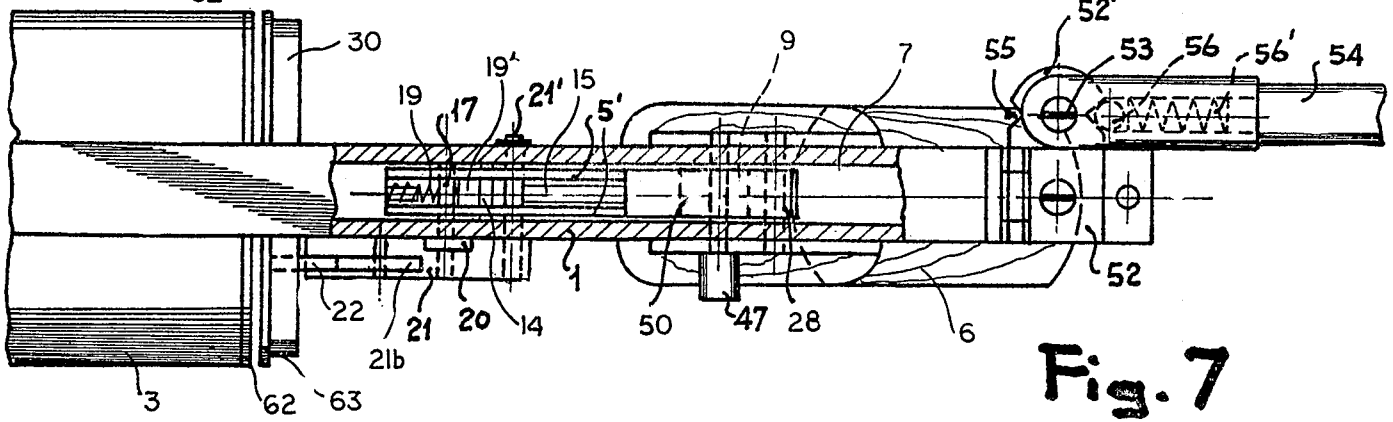
FIG. 7 is a top view, also partly in section, of the portion of the revolver shown in FIG. 6.

In the drawing I have shown a revolver, e.g. one adapted to be used for target practice, whose body consists of a jacket 1 of sheet metal bent into inverted-U shape to encompass the elements of its firing mechanism described hereinafter. Jacket 1 is attached at its rear to a pistol grip 6 and at its front to a barrel 11. A block 52 fastened to the rear end of jacket 1 has a lateral lug 52' (FIG. 7) to which a shoulder stock 54 is articulated by a screw 53; lug 52' has a semicircular outline with two diametrically opposite notches 55 that are selectively engageable by a ball check 56 in a bore of stock 54 under pressure of a spring 56'. Thus, the shoulder stock can be swung from its illustrated rearwardly pointing position into a withdrawn position alongside body 1 and barrel 11. In the modified revolver of FIG. 2 an extra-long barrel 111 is provided with a prop 154.

Figure 9:
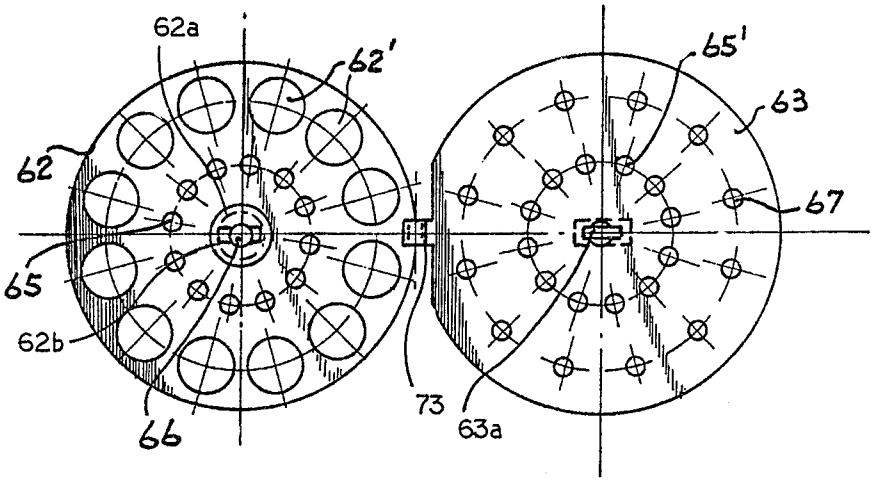
FIG. 9 is a face view of a loader for the revolver of FIGS. 1–8, shown in open position.
Figure 11:
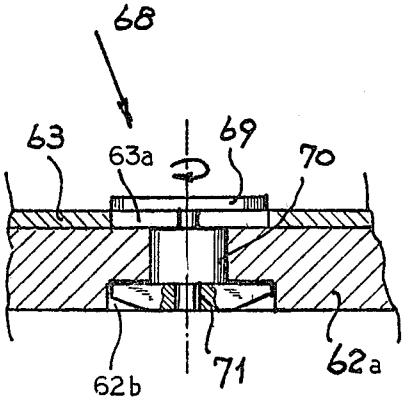
FIG. 11 is an enlarged sectional detail view of a closure device for the loader of FIGS. 9 and 10.

The front end of jacket 1 partly embraces a substantially rectangular vertical frame serving for the support of a cylinder 3, this frame including a fixed portion 2 and a swingable portion 2'' in the form of a generally J-shaped yoke. A shorter, lower leg of that yoke forms an extension of a similar leg of frame portion 2 and is pivotally secured thereto by a horizontal bolt 34 which has a countersunk head 34' and a threaded tip 34'', see FIGS. 2A and 3. Bolt 34 defines a pivotal axis b which is parallel to the boresight axis a of barrel 11 and to an axis of rotation c of cylinder 3 defined by a longer, upper leg 2' of yoke 2''. This upper leg 2' serves as an axle for cylinder 3 and also accommodates an ejector 57 including a spring-loaded bolt 57' with a head 57'' lodged in a recess 3' of the cylinder (see FIG. 10) in the normal working position (FIGS. 1, 3, 6 and 7) in which the cylinder axis c lies more or less directly beneath the barrel axis a. From that working position the cylinder can be swung laterally outward about pivotal axis b into a reloading position, illustrated in FIG. 2A, in which a multiplicity of cartridge chambers 3'' are accessible. In the present instance the cylinder 3 has 12 such chambers to accommodate as many cartridges 64 which can be introduced in that position with the aid of a loader 61 more fully described hereinafter with reference to FIGS. 9–11. A manually operable latch 36 on yoke 2'' serves for locking the cylinder 3 in its working position. The top of the fixed frame portion 2, bracketed by the sidewalls of jacket 1, is fastened to that jacket by several screws 2a at locations above the level of barrel 11.

Figure 1:
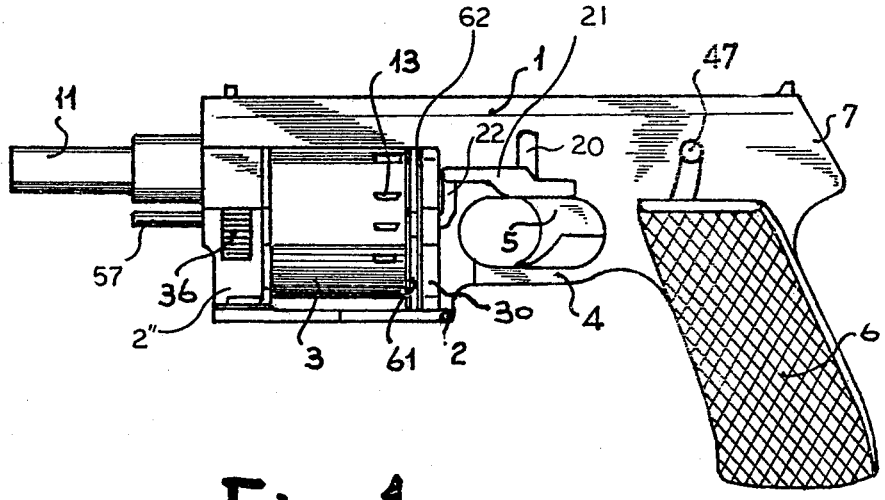
FIG. 1 is a side-elevational view of a revolver embodying my invention.
Figures 3, 4:
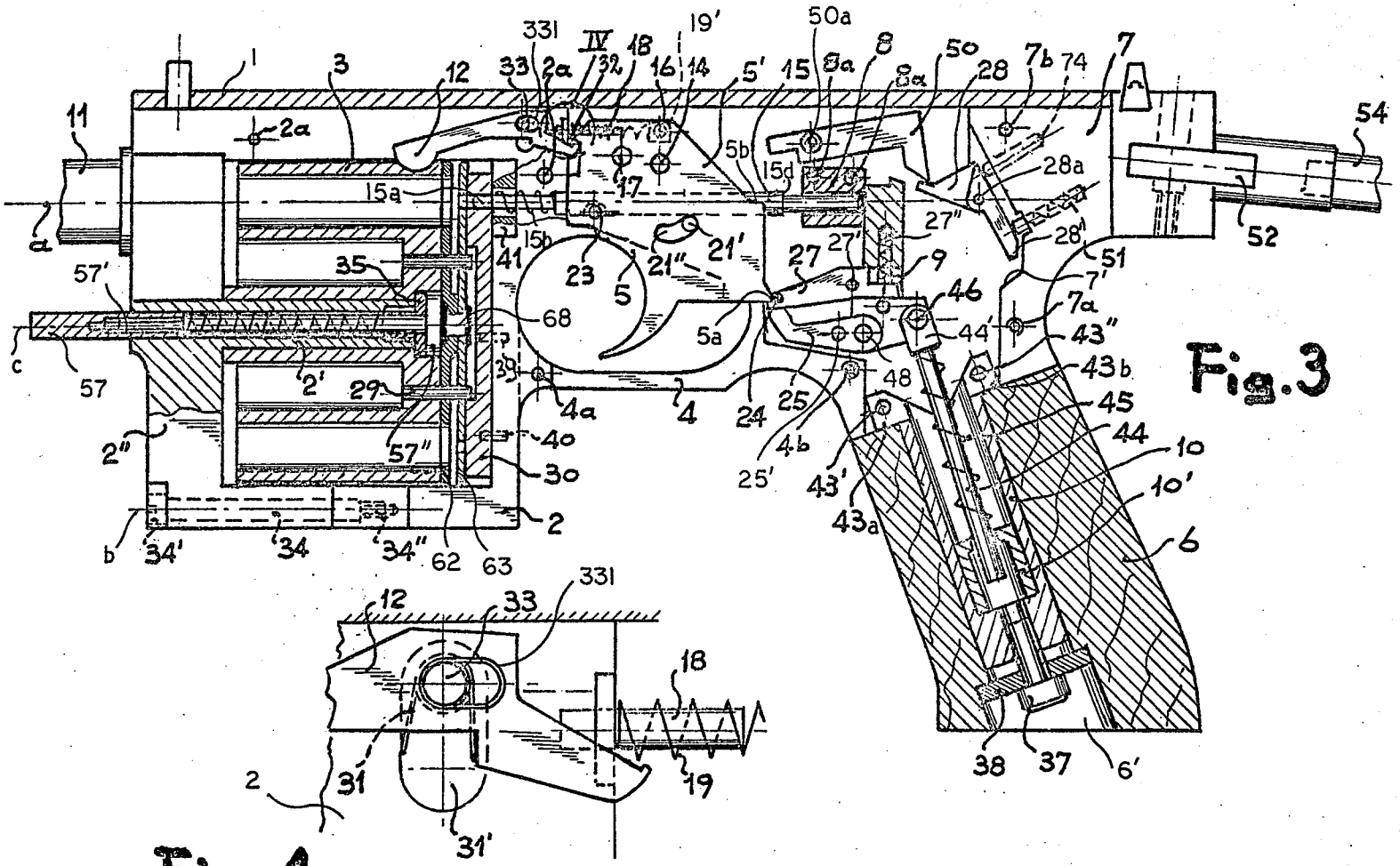
FIG. 3 shows the revolver in lateral sectional elevation and on a scale larger than that of the preceding Figures, with the hammer of its firing mechanism uncocked.
FIG. 4 is a fragmentary side-elevational view of a detail encompassed by a circle IV in FIG. 3, drawn to a still larger scale.

Also disposed within the jacket above that level is a detent 12 engageable with notches 13 (see FIG. 2) in the outer periphery of cylinder 3 for releasably retaining that cylinder in any of 12 angular positions in which an uppermost chamber 3'' is aligned with barrel 11. Detent 12 comprises a level with an elongated aperture 331 (see FIGS. 3–5) which is traversed by a pivot pin 33 supported by frame section 2 and jacket 1; a hairpin spring 31 encircles the pin 33 in a cutout 31' of frame portion 2 to bias the detent into its indexing position. Lever 12 has a tail normally engaging in a notch 32 (see FIG. 5) of a trigger 5 which is swingable about a fulcrum above the barrel axis, this fulcrum being constituted by a transverse pin 14 bridging the walls of jacket 1. The finger stop of trigger 5 lies in a generally elliptical cutout 4' bounded in part by frame portion 2 and in part by a trigger guard 4 bolted to that frame portion and to jacket 1 by screws 4a, 4b. Trigger 5 is biased into its normal position, illustrated in FIGS. 3 and 6, by a spring 19 which surrounds a bolt 18 rigid with frame portion 2, as best seen in FIG. 4, and terminates in an anchor block 19' swivelable about a pin 16 on the upper part 5' of the trigger. This upper part 5' consists of two parallel cheeks, see FIGS. 7 and 8, which are separated by a vertical slot 72 accommodating a striker pin 15. The latter is in line with barrel axis a and has a reduced tip 15a surrounded by a compression spring 15b tending to hold the striker pin in an inoperative position, spaced from a confronting cartridge 64, in which it is normally indexed by a pin 23 on trigger part 5' entering a notch 15c on its periphery; this inoperative position is defined by a shoulder 15d abutting a block 8, fastened to jacket 1 by screws 8a, in which the tail end of striker pin 15 is guided.

Figure 10:
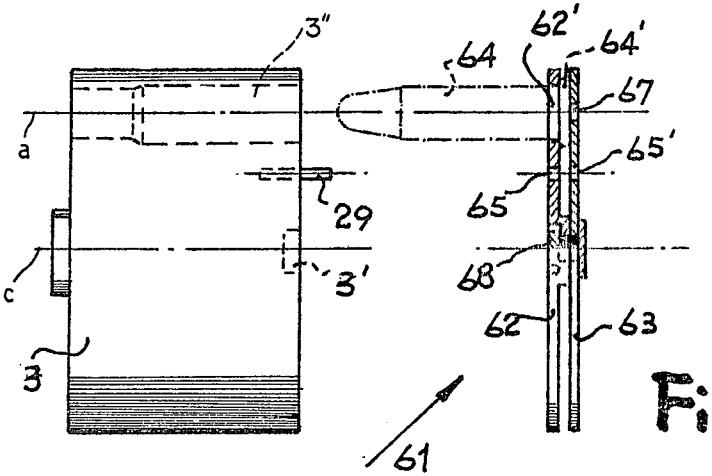
FIG. 10 is a side-elevational view of the cylinder of the revolver juxtaposed with the loader of FIG. 9 (partly in section), shown in closed position.

Spring 15b abuts a fixed shield 30 which is secured to lateral wings 41 of frame portion 2 and also has locator pins 39, 40 entering this frame portion. This shield, which further has a bore 30' (see FIG. 5) receiving the tip 15a of striker pin 15, is a circular disk of the same diameter as cylinder 3 and is spaced in the working position of that cylinder from a rear face thereof by an axial clearance sufficient to accommodate the loader 61 after a new round of cartridges 64 have been introduced into the chambers 3'' in the swung-out position of FIG. 2A. That loader, as particularly illustrated in FIGS. 9–11, consists of two substantially coextensive disks 62 and 63 which are interconnected by a hinge 73 for movement between an open position, FIG. 9, into a folded position, FIG. 10, in which these two disks are closely juxtaposed to form a pancake-like structure. The first or holding disk 62, which in a reloading operation directly abuts the rear face of cylinder 3, has 12 peripheral apertures 62' adapted to register with the respective cylinder chambers 3'', these apertures being penetrated by bodies of cartridges 64 whose enlarged rear flanges 64' are sandwiched between holding disk 62 and the second or backing disk 63 when the latter is swung into line with the former as seen in FIG. 10. The two disks are then interconnected with the aid of a locking device 68 comprising a stud 70 which is fitted into a central bore 66 of a boss 62a of disk 62 and is provided with a hammerhead 71 received in a recess 62b of that boss; an opposite end of stud 70 carries a transverse catch 69 adapted to pass through a slot 63a of disk 63 and to be thereupon rotated through 90° into a retaining position. Disk 62 is further provided with an array of smaller bores 65 which in the folded position of FIG. 10 are aligned with respective bores 65' of disk 63 in order to give passage to respective rods 29 (FIGS. 3 and 5) that project rearward from cylinder 3 and serve as stepping teeth for the advance of the cylinder from one angular position into the next. Moreover, disk 63 has holes 67 alignable with the centers of apertures 62' in disk 62 in order to register successively with the bore 30' of shield 30 for traversal by the tip 15a of striker pin 15 when the gun is being fired.

Figure 8:
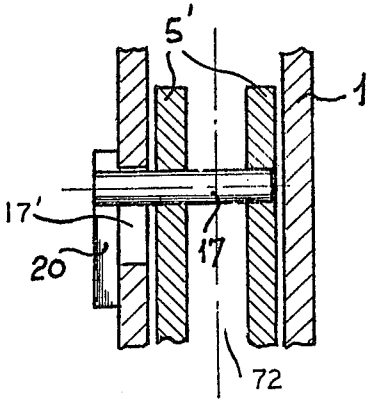
FIG. 8 is a fragmentary cross-sectional detail view drawn to a larger scale and taken substantially on the line VIII—VIII of FIG. 6.
Figure 6:
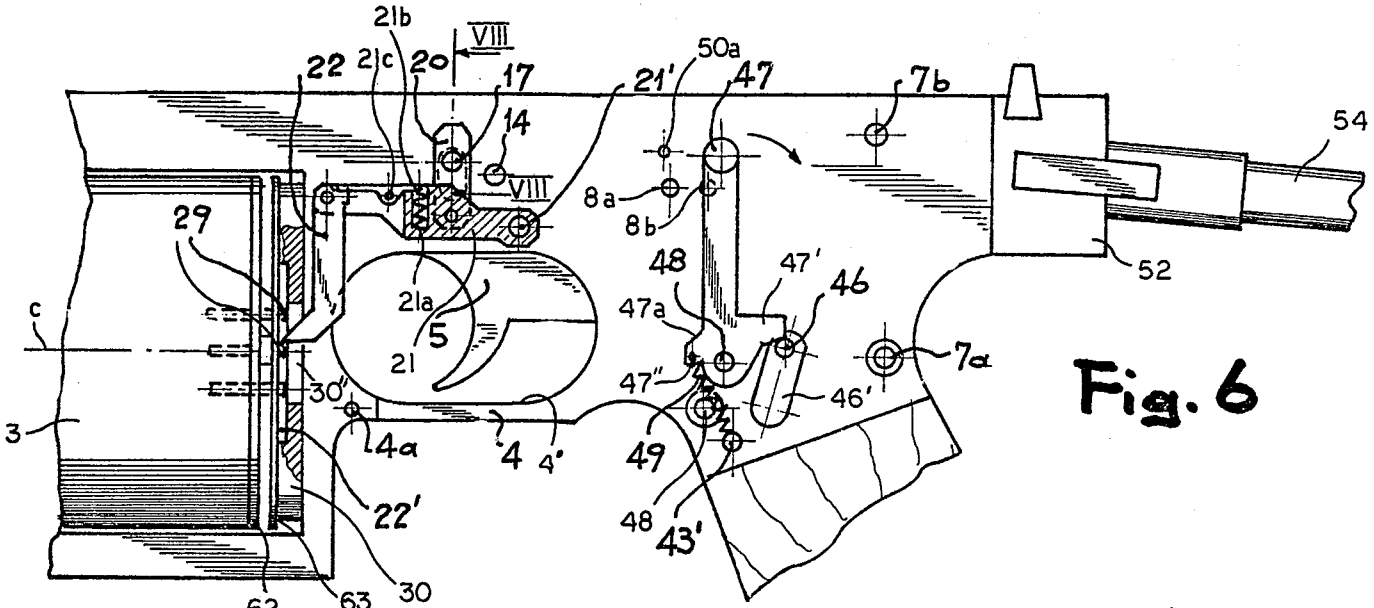
FIG. 6 is a fragmentary side-elevational view, partly in section and drawn to the same scale as FIGS. 3 and 5, of a rear portion of the revolver.

Shield 30 is provided at its front face with a shallow recess 22' which accommodates the projecting tips of teeth 29 and is laterally open so as not to interfere with the aforedescribed swing of cylinder 3 into its reloading position. The projecting tips coact with a pawl 22 which is disposed outside the body of the firearm and penetrates a slot 30'' of the shield (see FIG. 6) whose height exceeds the spacing between two adjoining teeth 29. Pawl 22 is articulated to a bifurcate forward end of a lever 21 which closely adjoins the outer surface of the left-hand wall of the walls of jacket 1 (as viewed by the user) and is pivoted at its rear end to a pin 21' traversing a slot 21'' in that wall. A spring 21a lodged in a recess of lever 21 bears upon a finger 21b which is pivoted thereto at 21c and engages the upper end of pawl 22 for yieldably positioning the lower end of that pawl within the orbit of stepping teeth 29. Lever 21 is further articulated to a link 20 which pivots on a pin 17 that traverses a slot 17' in the adjoining wall of jacket 1 and is fastened to the split part 5' of trigger 5 as best seen in FIG. 8. When the trigger 5a is retracted from its normal position, in which it is held by the engagement of pin 17 with the top of slot 17', the counterclockwise motion of the trigger around its fulcrum 14—against the force of restoring spring 19—lowers the pin 17 and with it the pawl 22 even as detent 12 is caused to swing clockwise from the position of FIG. 3 to release the cylinder 3 from its indexed angular position. Detent 12, escaping from the recess 32 of the trigger by virtue of the limited horizontal mobility of its pivot pin 33 in aperture 331, immediately returns to its indexing position under the force of hairpin spring 31 (FIG. 4) so as to arrest the cylinder 3 in its next angular position in which an unspent cartridge is aligned with striker pin 15 and barrel 11.

A hammer 9, normally abutting the block 8 in contact with the rear end of striker pin 15 as shown in FIG. 3, is fulcrumed on a pin 48 which bridges the walls of jacket 1 just above the pistol grip 6. Hammer 9 is articulated by a pin 46, traversing a slot 46' in the left-hand wall, to a head 44' at the end of a rod 44 which is slidably guided in a bushing 10' of a tubular insert 10 seated in the grip 6. Insert 10 has shoulders 43*a*, 43*b* which are fastened by bolts 43', 43" to the jacket 1 and abut the shell of the pistol grip, made for example of wood or synthetic resin, which is held in position by a screw 37 threaded into that insert and bearing upon a washer 38 in a recess 6' of grip 6. Rod 44 is surrounded by a coil spring 45, compressed between head 44' and bushing 10', which tends to keep the hammer 9 in the normal position of FIG. 3. This hammer further carries a lug 27 which is pivoted to it at 27' and is held by a tension spring 27" in a position generally perpendicular to the contact surface of the hammer. Lug 27 ends in a pin 24 normally resting against a hump 5*a* of trigger 5, pin 24 being also cradled in a bifurcate extremity of another lug 25 fixedly secured to hammer 9 by its pivot pin 48 and by a screw 25'. Pin 48 projects outward through the aforementioned left-hand wall of jacket 1 and serves as a fulcrum for a cocking lever or actuator 47 disposed outside that wall; an extension 47' of lever 47 bears upon the pin 46 while a lug 47" thereof is under tension of a spring 49 anchored to bolt 43', thereby tending to hold the lever against a fixed stop 47*a*.

Another fixed block 7 is mounted inside jacket 1 by screws 7*a*, 7*b* and carries a pin 74 which serves as a backstop for a sear 28 which is fulcrumed to the jacket at 28*a*. An extremity 28' of sear 28 is engageable with a projection 9' of hammer 9 in a cocked position of the latter as illustrated in FIG. 5; an opposite rear extremity 28" confronts an extremity 50' of a latch 50 which is pivoted to jacket 1 at 50*a* and has an opposite extremity 50" engageable by a hump 5*b* of trigger 5 when the latter is retracted to the full extent allowed by cutout 4'.

Figure 5:
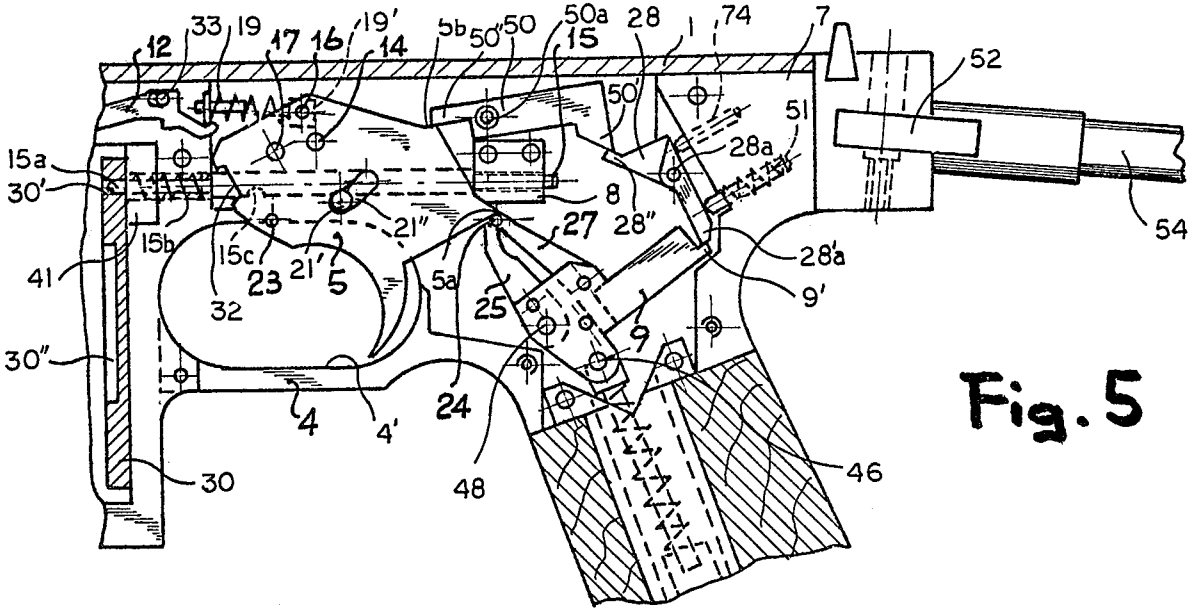
FIG. 5 is a sectional elevational view similar to that of FIG. 3, showing part of the firing mechanism with the hammer in cocked position.

A partial retraction of the trigger into the position of FIG. 5 results in a cocking of hammer 9 as hump 5*a* displaces the pin 24 of lug 27 whereby the hammer is swung clockwise to cam aside the sear 28 whose extremity 28' thereupon drops in behind the projection 9'. In this position, in which the driving spring 45 inside pistol grip 6 is compressed by the depression of pin 46, the opposite extremity 28" of sear 28 is still engaged by the confronting end 50' of latch 50 whose opposite end 50" rests on the hump 5*b* of trigger 5. The pullling of the trigger into the cocked position of FIG. 5, against the force of restoring spring 19, also has advanced the cylinder 3 by one rotary step whereby striker pin 15 confronts a fresh cartridge in the chamber 3" now aligned therewith. In the position of FIG. 5, furthermore, the pin 24 of lug 27 has been released from the hump 5*a* of the trigger by virtue of an escapement motion of that lug against the force of retaining spring 27" (FIG. 3) as the hammer 9 is briefly backstopped by an edge 7' of block 7. With striker pin 15 disengaged from the retaining pin 23 of the trigger, its rear end projects from block 8 under pressure of spring 15*b* to the extent permitted by its shoulder 15*d*. A further retraction of the trigger swings the latch 50 clockwise, as viewed in FIG. 5, to entrain the sear 28 in a counterclockwise sense (against the force of spring 51) whereby the hammer 9 is liberated and strikes the projecting end of pin 15 whose tip 15*a* now detonates the confronting cartridge.

The described double-action mode of firing can be replaced by a single-action mode if the hammer 9 is precocked by a clockwise swing of lever 47 (FIG. 6) with resulting depression of pin 46 and compression of spring 45 but without any displacement of trigger 5 from its normal position shown in FIG. 3. A subsequent pulling of the trigger steps the cylinder 3 in the aforedescribed manner and immediately thereafter trips the latch 50 to uncock the hammer 9 so as to fire the gun.

I claim:

1. A revolver comprising:

a body provided at a rear end thereof with a pistol grip and at a front end thereof with a forwardly projecting barrel;

a frame secured to the front end of said body and disposed in a substantially vertical plane extending in the direction of said barrel;

a cylinder with a multiplicity of cartridge chambers rotatable within said frame about a shaft paralleling said barrel, said cylinder having a multiplicity of rotary positions in which a respective chamber thereof is aligned with said barrel;

a trigger disposed between said frame and said pistol grip substantially at the level of said shaft, said trigger being swingable parallel to said vertical plane about a fulcrum on said body substantially at the level of said barrel;

detent means engageable with said cylinder for arresting same in any of said rotary positions;

stepping means disposed in said body above the level of said barrel and controlled by said trigger for advancing said cylinder from one rotary position to the next upon a retraction of said trigger, said detent means being coupled with said trigger for temporarily disengaging said cylinder during said retraction; and a firing mechanism in said body including a striker pin in line with said barrel behind said cylinder, a hammer engageable with an end of said striker pin remote from said cylinder, said hammer being swingable about a pivot located substantially on the level of said trigger and being operatively coupled with said trigger upon retraction thereof for swinging from a normal position adjacent said striker pin into a withdrawn position remote from said striker pin with subsequent decoupling of said hammer from said trigger; and spring means connected with said hammer for driving same against said striker pin upon the decoupling thereof from said trigger.

2. A revolver as defined in claim 1 wherein said body comprises a sheet-metal jacket of inverted-U shape folded about said detent means, said firing mechanism and part of said frame.

3. A revolver as defined in claim 1 or 2 wherein said stepping means comprises a pawl reciprocably mounted on an outer wall surface of said body, said cylinder being provided with lugs projecting axially from a rear face thereof for engagement by said pawl.

4. A revolver as defined in claim 3, further comprising a stationary shield rigid with said frame confronting said rear face, said shield having a slot penetrated by said pawl.

5. A revolver as defined in claim 4 wherein said frame comprises a fixed section secured to said body and a yoke-shaped section swingable about a pivotal axis underneath said cylinder, said yoke-shaped section forming an axle parallel to said barrel and to said pivotal axis on which said cylinder is rotatably supported while being selectively swingable between a working position in front of said shield and a reloading position laterally offset from said shield.

6. A revolver as defined in claim 5, further comprising loading means for enabling the introduction of fresh cartridges into said chambers, said loading means including a first disk provided with a multiplicity of peripherally spaced-apart apertures respectively alignable with said chambers and a second disk juxtaposable with said first disk for the retention of cartridges inserted into said apertures, said disks juxtaposed with each other and with said cylinder being receivable in a clearance existing between said rear face and said shield in said working position, said second disk having holes alignable with said apertures for penetration by said striker pin.

7. A revolver as defined in claim 6 wherein said disks are hingedly interconnected and are provided with locking means for holding them juxtaposed with each other.

8. A revolver as defined in claim 6 wherein said axle is provided with an ejector bearing resiliently upon said first disk in said working position for dislodging same from said cylinder upon a swing thereof into said reloading position.

9. A revolver as defined in claim 1 or 2 wherein said spring means comprises a compression spring lodged in said pistol grip.

10. A revolver as defined in claim 1 or 2 wherein said firing mechanism further includes latch means for holding said hammer cocked immediately upon decoupling thereof from said trigger and for releasing said hammer upon a further retraction of said trigger.

11. A revolver as defined in claim 10 wherein said firing mechanism further comprises an externally accessible actuator engageable with said hammer for enabling manual cocking thereof independently of said trigger.

12. A revolver as defined in claim 11 wherein said actuator comprises a lever projecting laterally from said body.

13. A revolver as defined in claim 1 or 2 wherein said frame is rigid with a trigger guard extending toward said pistol grip below said body.

14. A revolver as defined in claim 13 wherein said trigger comprises a downward extension of a plate projecting upward into said body and having a vertical clearance traversed by said striker pin.

* * * * *